US007805870B2

(12) United States Patent
Calderwood

(10) Patent No.: US 7,805,870 B2
(45) Date of Patent: Oct. 5, 2010

(54) VEHICLE DISPLAY SYSTEM

(75) Inventor: Ian Leonard Calderwood, East Farleigh (GB)

(73) Assignee: Carmelion Limited, Great Britain (GB)

( * ) Notice: Subject to any disclaimer, the term of this patent is extended or adjusted under 35 U.S.C. 154(b) by 61 days.

(21) Appl. No.: 12/296,140

(22) PCT Filed: Apr. 5, 2007

(86) PCT No.: PCT/GB2007/001276

§ 371 (c)(1),
(2), (4) Date: Oct. 6, 2008

(87) PCT Pub. No.: WO2007/113574

PCT Pub. Date: Oct. 11, 2007

(65) Prior Publication Data

US 2009/0158630 A1 Jun. 25, 2009

(30) Foreign Application Priority Data

Apr. 6, 2006 (GB) ..... 0607002.3
Nov. 29, 2006 (GB) ..... 0623878.6

(51) Int. Cl.
*G09F 21/04* (2006.01)

(52) U.S. Cl. ..... 40/591; 160/328; 40/603; 40/590

(58) Field of Classification Search ..... 40/591, 40/603, 604; 160/327, 328; 52/222, 716.6, 52/716.8

See application file for complete search history.

(56) References Cited

U.S. PATENT DOCUMENTS 4,403,642 A 9/1983 Morris (Continued)

FOREIGN PATENT DOCUMENTS

AT 413364 B 3/2003

(Continued)

OTHER PUBLICATIONS

SAPA Aluminium Extrusion Manual; Publication dated Jan. 5, 1997; first edition 3000350; by SAPA'S Marketing Dept. & J&L Annonsbyra ÅB.

*Primary Examiner*—Joanne Silbermann
*Assistant Examiner*—Christopher E Veraa
(74) *Attorney, Agent, or Firm*—Cowan, Liebowitz & Latman, P.C.; Mark Montague, Esq.

(57) ABSTRACT

A system for displaying a banner (70) on a vehicle comprises mounting means (160) having channels (163), retaining means (112) for retaining the banner and associated with first and second locking members (124, 140) for engagement with the channels, the first locking member having a strut (134) locatable in a first channel, the second locking member having a second protruding strut (148) locatable in the same channel, and the first locking member further having a third protruding strut (135) spaced apart from the first strut and locatable within a second channel. When the locking members (124, 140) are aligned, the first strut (134) and second strut (148) are adjacent each other, the adjacent sides being parallel and the struts are located in the channels for secure attachment to the mounting means. The retaining means (112) may be connectable to the first locking member (124), e.g. by a pivot (115, 117), or it may form an integral member (53, 54, 35) therewith.

17 Claims, 5 Drawing Sheets

U.S. PATENT DOCUMENTS

| | | | | |
|---|---|---|---|---|
| 5,230,377 | A * | 7/1993 | Berman | 160/327 |
| 5,893,227 | A | 4/1999 | Johansson et al. | |
| 6,164,364 | A * | 12/2000 | Morris | 160/327 |
| 6,250,002 | B1 * | 6/2001 | Wittenberg | 40/603 |
| 6,513,272 | B2 * | 2/2003 | Richards et al. | 40/603 |
| 6,564,488 | B2 * | 5/2003 | Wittenberg | 40/603 |
| 6,574,895 | B2 * | 6/2003 | Nestor et al. | 40/603 |
| 6,698,123 | B2 * | 3/2004 | Smith | 40/603 |
| 7,159,349 | B2 * | 1/2007 | Uccello et al. | 40/603 |
| 7,275,340 | B2 * | 10/2007 | Andrews et al. | 40/590 |
| 2002/0194760 | A1 | 12/2002 | Wittenberg | |
| 2008/0256834 | A1 * | 10/2008 | Smith | 40/591 |

FOREIGN PATENT DOCUMENTS

| | | | |
|---|---|---|---|
| DE | 0495688 | A | 1/1992 |
| EP | 1271456 | A | 1/2003 |
| EP | 1408477 | B | 3/2003 |
| EP | 1604346 | B | 5/2007 |
| GB | 2382712 | A | 4/2003 |
| WO | 00/79507 | A | 12/2000 |
| WO | 0079507 | A | 12/2000 |
| WO | 0135382 | A | 5/2001 |
| WO | 03060333 | A | 7/2003 |
| WO | 03-083812 | A | 10/2003 |
| WO | 2004/044874 | A | 5/2004 |
| WO | 2004-081908 | A | 9/2004 |

* cited by examiner

FIG. 1
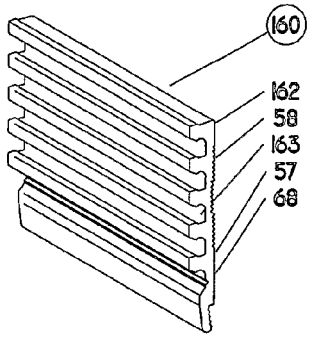
FIG. 2
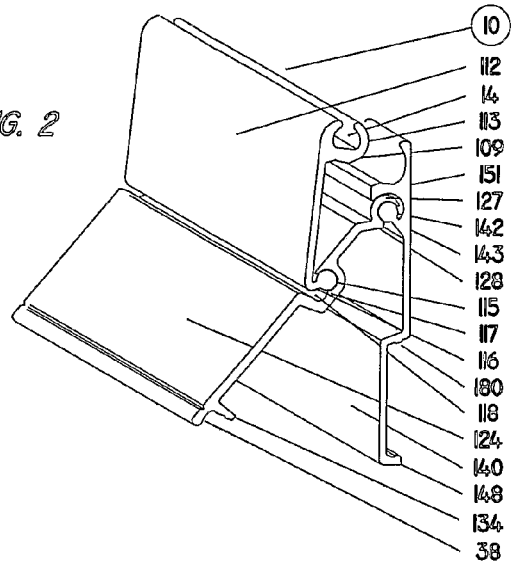
FIG. 3A
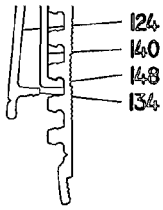
FIG. 3B
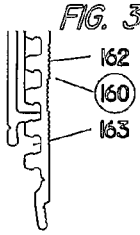
FIG. 4A
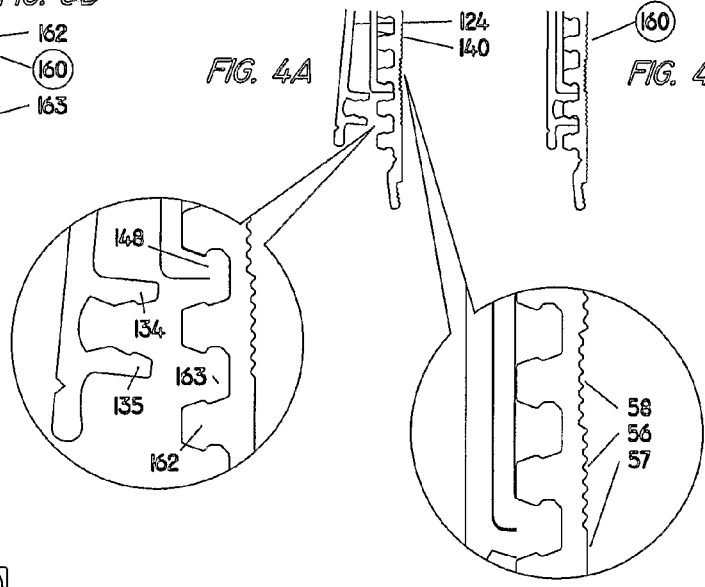
FIG. 4B
FIG. 5A
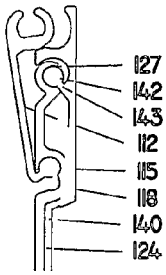
FIG. 5B
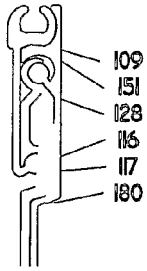

VEHICLE DISPLAY SYSTEM

The present invention relates to a Vehicle Display System for displaying a banner on a vehicle and a method for the same.

Advertisements and other messages have commonly been displayed on vehicles using self-adhesive vinyl. However, this is expensive to produce and requires skilled labour and a controlled environment to apply the vinyl to a vehicle. This is particularly disadvantageous for promotional messages or seasonal campaigns, which are changed frequently. Promotional messages in static locations are typically displayed by applying a paper product on a solid substrate such as a billboard. However, this is not suitable for a vehicle environment. One alternative is a promotional banner. This is typically a flexible PVC substrate upon which the message is printed. For use on a vehicle, it is important that the banner is securely fixed and tension is created so that the promotional message is clearly visible.

Framing systems exist for displaying promotional banners on the side of buildings and/or at exhibition sites. However, these are not suitable for use on a moving vehicle. Whilst some of these systems have been subsequently adapted and marketed for vehicle use, they have a number of disadvantages and most have had problems in gaining legislative approval for road use.

Several systems (such as those described in WO 0079507, US06/698,123 and U.S. Pat. No. 5,893,227) use a tool to create tension in the banner to locate a flange on an engagement surface. However, the structural integrity of the frame is dependent on the tension in the banner. If the banner becomes damaged then the frame dismantles and becomes detached even with the lock, a subsequent safety feature of the invention, in place. Furthermore, the frame system is secured to the vehicle using screw or rivet fixings. This invasive fixation method causes damage to the vehicles and is a particular concern for refrigerated lorries, which may be pierced by the system. Such fixings invalidate most vehicle warranties. In addition, the system does not comply with EU width restrictions when mounted on a refrigerated vehicle.

The system described in WO2004044874 uses a simple hinge combined with a series of retaining channels to allow adjustability and tensioning of the banner. A disadvantage of this system is the absence of mechanical leverage, which makes it difficult to create tension in the banner. Tension is created manually by inserting the banner into one of the retaining channels. If further adjustment is required after the banner is inserted, the channel section needs to be completely removed and re-inserted until the desired tension is achieved. This is time consuming. Once tensioned, the fixings required to keep the frame closed are under constant torsional stress.

GB 2,382,712 describes a two-part system; one part interacts with the other by way of a circular hinge to create a lever action and tension on the banner. The tensioning of the banner is dependent on the banner being manufactured to exact tolerance; there is no adjustability. The two parts are closed with a metal clip, which is under constant torsional stress, and unless opened frequently the aluminium and steel will corrode and fail which is detrimental to the structural integrity of the frame. The frame can only be mounted using invasive fixing.

EP 1,408,477 describes a system which uses a 3M product (DUALOCK™) to attach it to a vehicle. To comply with road safety legislation, the system can only be used with a promotional banner consisting of mesh. Air must travel freely through the mesh to avoid the creation of a sail effect, which would cause the frame to become detached from the vehicle.

A disadvantage of mesh is that it collects dirt and when bench marked against solid PVC the banner is regarded as a short-term product. Furthermore, the mesh does not allow accurate colour reproduction.

AT 413, 364 and EPA 1,604,346 describe a tightening frame for tarpaulin which is an adaptation of frames disclosed earlier in the SAPA Aluminium Extrusion Manual (Publication date Jan. 5, 1997, first edition 3000350, made by SAPA's Marketing Dept and J&L Annonsbyra ÅB). The frame is a three part tightening part frame which engages with a rounded off groove. The three parts of the tightening frame are connected via scroll hinges. A fundamental problem with this system is that the three parts of the tightening frame are prone to lock together before engagement with the rounded off groove. In this situation, the parts are extremely difficult to separate and the parts are easily damaged. Furthermore, when positioned vertically the tightening frame is prone to slipping, which in the first instance is temporarily prevented by the presence of a corner component. However, when the movement of the vehicle causes vibration, the corner is unable to hold the weight of the tightening frame leading to a significant hazard.

The present invention seems to overcome one or more of the above disadvantages.

According to a first aspect of the present invention, there is provided a system for displaying a banner on a vehicle comprising of mounting means for attaching to the vehicle, said mounting means having at least two channels, retaining means for retaining a banner, said retaining means being associated with locking means for engagement with the at least two channels, said locking means comprising first and second members, said first member having a first protruding strut locatable in a first channel, and said second member having a second protruding strut locatable in the first channel, the first locking member further having a third protruding strut spaced apart from the first strut and locatable within a second channel spaced apart from the first channel wherein the first member is movable relative to the second member such that when the members are aligned, the first strut and second strut are adjacent each other, the adjacent sides being parallel and whereby when the struts are located in the channels, the locking means is securely fastened to the mounting means.

An advantage of this system is that the locking means do not become locked together when not in use (i.e. outside of the channel). In use, the locking means severely mate with the mounting means and the system is securely fastened. The joint sum of the first and second struts is greater than the exit of the channel.

A further advantage of this system is when torsional stresses apply force on the second strut, the third strut is engaged with an additional channel, preventing the second strut from becoming detached. Thus torsional stress from a tensioned promotion banner is neutralised. The system is resistant to vehicle vibration. The system does not rely on the tension of the barrier for its structural integrity.

Advantageously, each strut extends substantially perpendicular to its respective member. However, each strut may extend at an acute or obtuse angle although this is not preferred.

The retaining means may be connectable to the locking means or may be integral therewith.

In a preferred embodiment, when the first and second members are aligned, the distal ends of the struts are aligned. One strut could extend beyond the other if a corresponding change was made to the channel to ensure the struts be locked within.

Preferably, for at least one of the struts, the side of the strut facing the channel in use is flared. This improves the lock (preferably a snap-lock or snap-fit). The channel is correspondingly shaped to hold the struts.

The first member is typically pivotable with respect to the second member.

The retaining means is typically pivotable with respect to the locking means. In a preferred embodiment, the retaining means forms a captive joint, ideally a rod and socket captive joint, or a ball joint, with the first locking member. An alternative is a captive knuckle joint. An advantage is that the movement is limited to one plane and the parts do not unintentionally slide with respect to one another (hence captive), for example in response to vehicle vibration.

The retaining means preferably has a head portion incorporating a channel. Advantageously, the base of the channel is substantially planar. In a preferred embodiment, said channel has a semi-circular shape. The depth of the head portion beneath the channel may be from 1 mm to about 10 mm, preferably from 2 mm to about 4 mm, most preferably about 3 mm. This ensures that if the retaining means receives an impact (for example in a vehicle accident), the sides of the channel will not collapse and trap the flexible mounting member inside.

Preferably the system includes a flexible mounting member for mounting the banner. The system may also include a banner attached to the mounting member. The flexible mounting member preferably comprises a PVC compound.

The mounting means may have from two to fifteen channels, preferably from five to ten channels. This allows the system to be adjustable for example depending on the size of banner to be displayed.

According to a second aspect of the present invention, there is provided a method for displaying a banner on a vehicle including the steps of: attaching the banner to a flexible mounting member, attaching mounting means to the vehicle, said mounting means having at least one channel, securing the flexible mounting member to retaining means for retaining the banner, the retaining means being provided with locking means for engagement with the channel, said locking means comprising first and second members, the first member having a first protruding strut locatable in a first channel, the second member having a second protruding strut locatable in the first channel, locating the second strut in the channel, moving the first member relative to the second member such that the members are aligned and the first strut is located in the channel adjacent the second strut, the adjacent sides of the struts being parallel, and locating a third strut depending from the first member in a second channel such that when the struts are located in the channels, the locking means is securely fastened to the mounting means.

The system is easy to fit and does not require skilled labour or a controlled environment.

Preferably, the step of attaching the banner to the flexible mounting member involves welding using radio frequency waves.

The mounting means may be attached to the vehicle by adhesive means. Mechanical fixing is merely optional. By omitting mechanical fixing, the vehicle manufacturer's warranty is not affected since the vehicle is not pierced.

Preferred embodiments of the invention will now be described by way of example only and with reference to the drawings in which;

FIG. 1 is a perspective view of a mounting means in accordance with a preferred embodiment of the invention;

FIG. 2 is a perspective view of the retaining means connected to the locking means in accordance with the preferred embodiment of the invention;

Figure 6A:
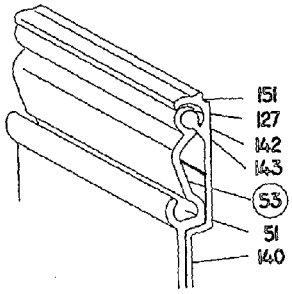
Figure 6B:
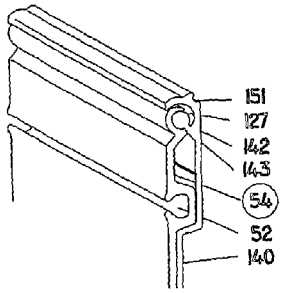
Figure 6C:
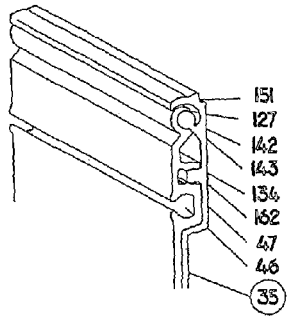
Figure 7:
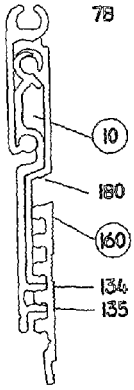
Figure 8A:
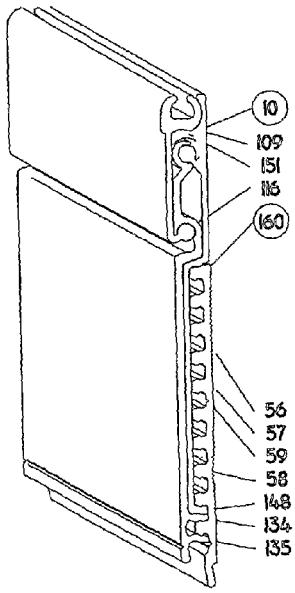
Figure 8B:
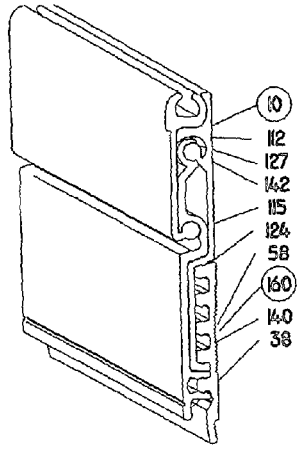
Figure 9A:
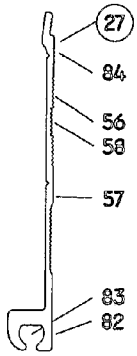
Figure 9B:
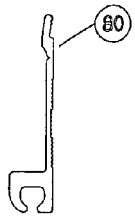
Figure 9C:
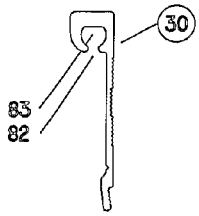
Figure 10:
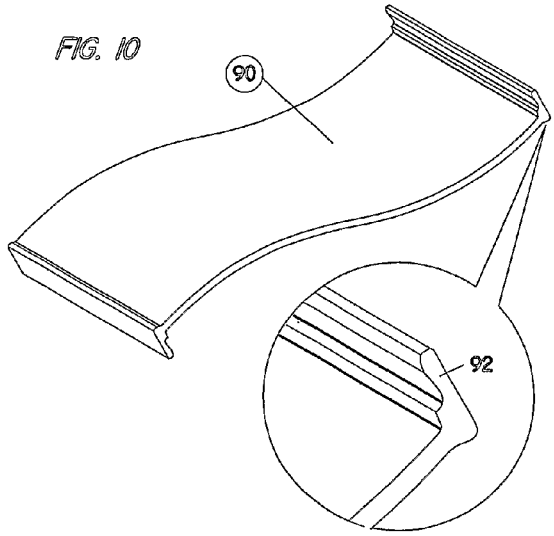
Figure 11A:
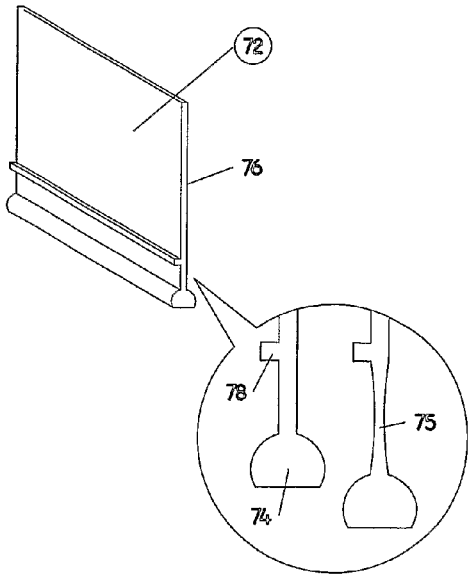
Figure 11B:
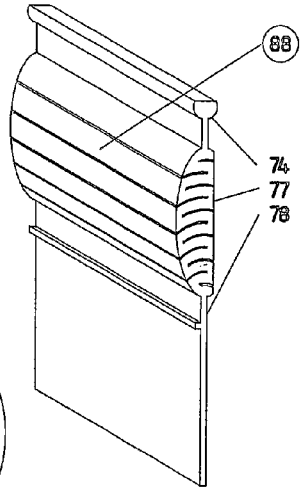
Figure 11C:
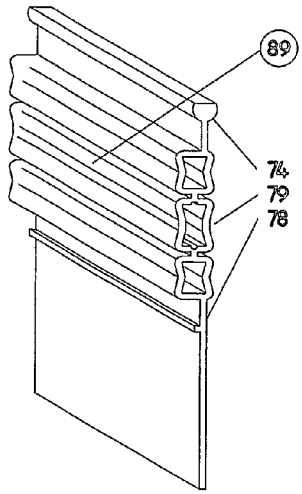

FIGS. 3*a* and 3*b* are side section views of the locking means engaged with the mounting means, in accordance with a preferred embodiment of the invention; FIG. 3*a* shows the first locking member engaged with the mounting means and FIG. 3*b* shows both the first and second locking members so engaged;

FIGS. 4*a* and 4*b* are three-dimensional side section views of the locking means engaged with the mounting means in accordance with a preferred embodiment of the invention; FIG. 4*a* shows a locking member engaged with the mounting means and FIG. 4*b* shows both the first and second locking members so engaged. The close up view of FIG. 4*a* illustrates how the extrusion is shaped inside the channels;

FIG. 5 is a side section view showing the retaining means in an unlocked (5*a*) and locked position (5*b*) according to a preferred embodiment of the invention;

FIGS. 6*a* to 6*c* are perspective views three alternative embodiments of the invention where the retaining means is an integral part of the first locking member;

FIG. 7 is a side section view of the Vehicle Display System in a locked position;

FIGS. 8*a* and 8*b* are perspective views showing variations of the mounting means with a series of either five (FIG. 8*a*) or ten (FIG. 8*b*) mushroom shaped protrusions, in a locked position in accordance with the second embodiment of the invention. These views illustrate how the extrusion is shaped inside the channels;

FIGS. 9*a* to 9*c* are side section views three alternative fixed upper frame portions;

FIG. 10 is a perspective view of an example of a tool for unlocking the system;

FIGS. 11*a* to 11*c* show a perspective view of a flexible mounting members, 11*a*, 11*b* and 11*c;*

Figure 12A:
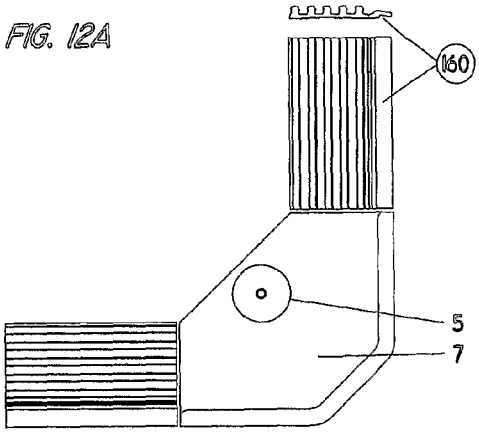
Figure 12B:
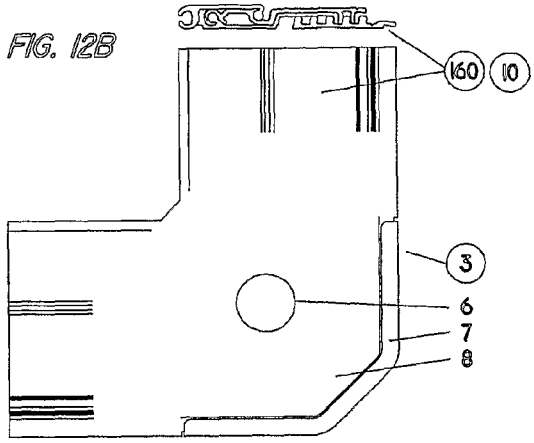
Figure 13:
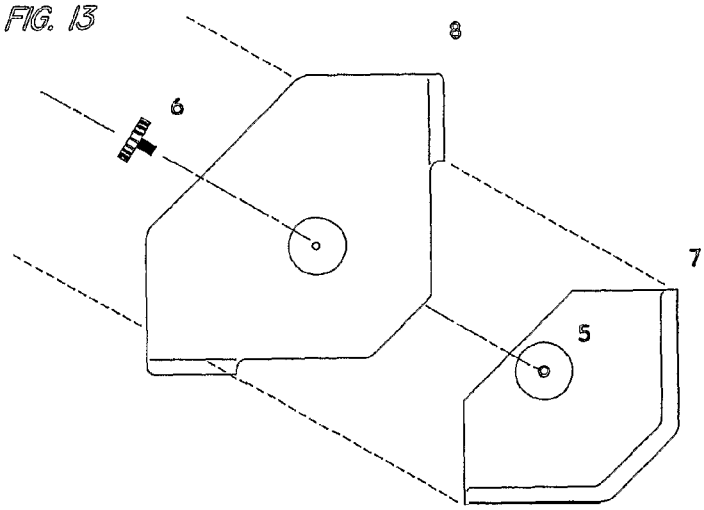
Figure 14:
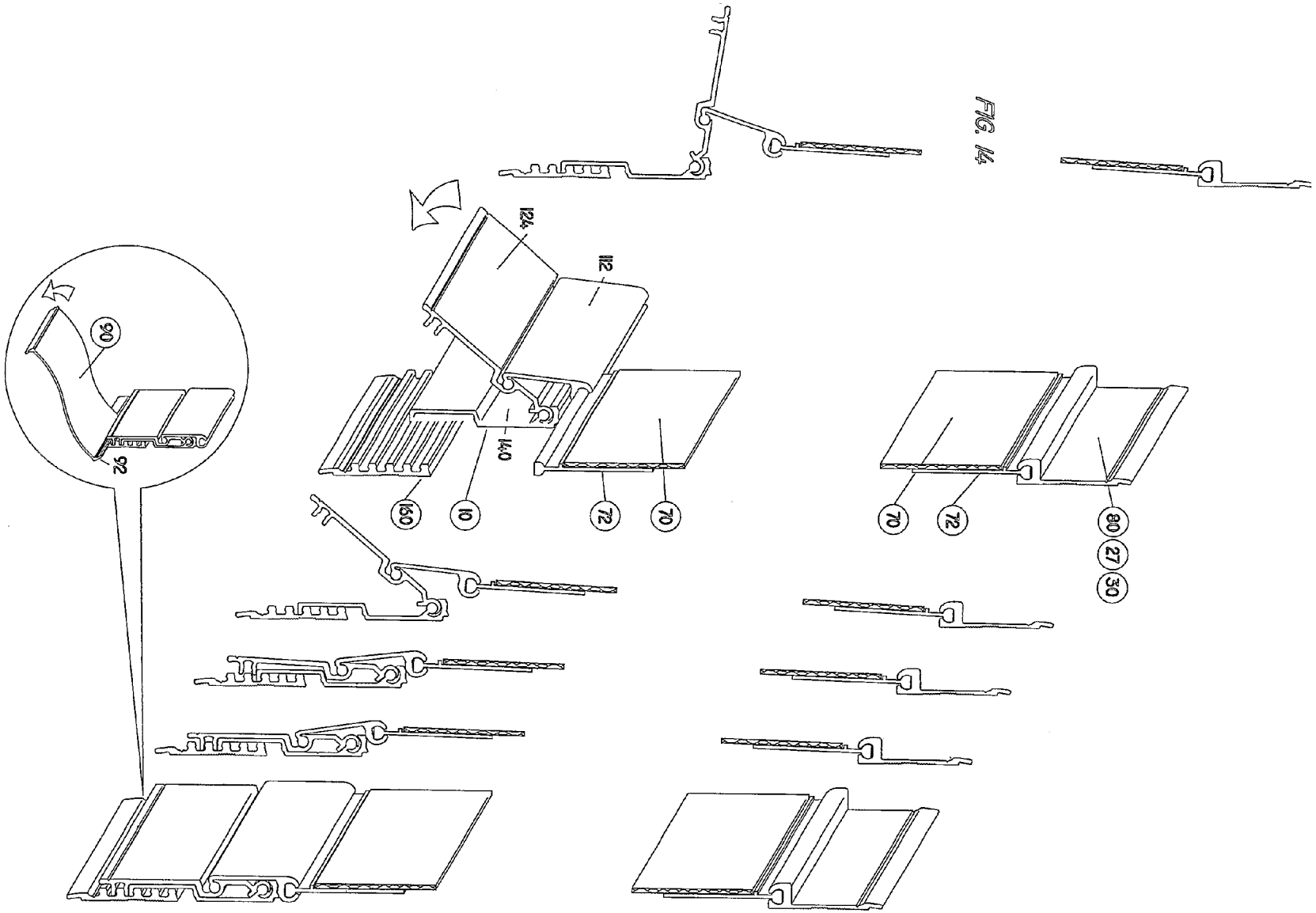

FIGS. 12*a* and 12*b* are exploded views of corner devices for use with the system;

FIG. 13 is a detailed drawing of a corner retaining member interacting with the mounting means; and FIG. 14 is an operational drawing showing (from left to right) the preferred second embodiment of the system;

Referring to the Figures, the tensioning device 10 comprises a banner retaining means 112. The head portion 113 of the retaining means 112 has a channel 14 for retaining a flexible mounting member 72 and associated banner 70. The body portion of the retaining means 112 has an elongate body ending in a tail portion, which has a bent portion 116 terminating in a rod joint 115. The retaining means 112 engages with the first locking member 124. The first locking member has releases 117, 118 for engaging the retaining means 112 to form a hinge. When the retaining means 112 in a locked position, rod 115 sits in the deep recess 117 adjacent a concave recess 118 and acts as a rod & socket captive joint. When the retaining means 112 is being pivoted with respect to the first locking member via the rod joint 115, the bent portion 116 can be received in the shallower recess of 118. This arrangement ensures rod 115 moves in one plane only.

The first locking member 124 provides the distal socket head portion 127 spaced apart from recesses 117, 118. Towards the opposite (tail) end of the first locking member 124 are two spaced apart struts 134 and 135, which extend substantially perpendicularly thereto. Strut 135 is not shown in FIGS. 2 and 3. The struts are essentially mirror images of each other. The distal end of the struts 134, 135 are flared on one side. The tail end of locking member 124 terminates in a finger 38, which in use acts as a tolerance lip to prevent the tensioning device 10 from being tampered with, or removed with any regular tool such as a screwdriver.

The mounting means or frame 160 has a series of mushroom shapes protrusions 162, which define a series of channels 163 there between. The base of the channels are typically substantially planar. In one example, the base of at least one channel may not be planar and may have a groove 58, 69 for locating a drill to attach the mounting means 160 to the vehicle with a screw or rivet fixing. They central channel may be grooved and/or and end channel may be grooved. Struts, 134, 135 act as a snap lock and engage either side of a mushroom shaped protrusion 162 when the system is in a locked position. The side of each strut facing protrusion 162 is configured to accommodate the profile of the protrusion. The opposing side of each strut is substantially planar.

The first locking member 124 engages with a second locking member 140. The distal socket head portion 127 of the first locking member 124 engages around a distal rod portion 142 of the second locking member 140, which protrudes from the second locking member via stem 143. When the distal rod & socket 127/142 are engaged, the base 128 of the distal socket head portion 127 abuts stem 143. This increases the contact surface area, providing increased stability of the pivots in the closed position and controls the center between the struts 134 and 135 of the first locking member 124. The struts 134, 135 are then engaged centrally over a mushroom shaped protrusion 162 of the mounting means 160.

Towards the opposite end from socket 142, the second locking member has a strut 148, the distal end of which is flared on one side to engage against the wall of the channel 163 in the mounting means 160. The tail portion of the first locking member is pushed towards the second member; with 127/142 acting as a pivot. The opposite side of the strut 148 is substantially planar. When the first and second locking members are engaged and locked together the substantially planar sides of struts 134 and 148 are preferably not in contact with each other, nor cooperate with each other, but locate in the recesses of a channel 163. The struts 134, 148 engage in the same channel 163 within the mounting means 160. The struts and channels are sized so that the engagement is snap-fit (negative interference snap lock). The mounting means 160 has a series of substantially parallel channels 163, typically five to ten.

On the reverse side of the mounting means 160 and on the reverse side of the upper frame portions 27, 30 and 80 there are textured portions 58 and 56 typically comprising of several grooves to improve bonding using an adhesive such as SIKA™ 552 and 5221 (available from Sika Limited, Watchmead, Welwyn Garden City, Hertfordshire AL7 1BQ). Adjacent the textured portions is a smooth portion 57. In use, a 4 mm bead of adhesive is placed in channel 58. When the mounting means 160 and the upper frame portions 27, 30 and 80 are secured in place on the vehicle surface the adhesive disperses leaving approximately a 2 to 3 mm thickness of adhesive in channel 58, about 1 to 2 mm thickness of adhesive in channel 56 and up to 1 mm thickness of adhesive on the smooth surface 57.

The tensioning device 10, (retaining means 112 locking means 124, 140) and mounting means 160 can be made from aluminium alloy (such as 6063 T6 aluminium alloy) or from TPE (Thermoplastic Elastomer) extrusion, or from materials with similar properties.

In use, the banner 70 is retained on four sides. The banner is hung from the top horizontal side, then fixed on a vertical side and tensioning of the banner is completed on the remaining two adjacent sides. To achieve this the Vehicle Display System preferably utilizes the mounting means 160 on one horizontal (bottom) and two vertical sides, whilst the remaining horizontal (top) side of the Vehicle Display System can utilize an upper frame portion 27, 30, 80.

The flexible mounting member must be flexible, the composition should not be rigid. The flexible mounting members 72, 88, 89 (FIGS. 11*a* to 11*c*) have a head portion 74 (half moon shaped) and an elongate tail portion 76. Part way along the tail portion 76 is beading 78. The banner 70 is attached to the tail 76 so that the edge of the banner rests against the beading 78. The member 72 in FIG. 11*a* is preferably used for flush vehicle sides and/or rears. The members 88, 89 in FIGS. 11*b* and 11*c* are preferably used for rear shutter doors on a vehicle and are expandable to mimic the rolling function of a rear shutter door.

The flexible mounting member 72 is made by extrusion of a polymer such as a Polyvinyl chloride (PVC) compound comprising:

| | |
|---|---|
| PVC compound | 60-80% |
| Plasticiser | 20-30% |
| Process Aid | 2-5% |
| Stabiliser | 0.5-1.5% |
| Pigment | 0.5-4.0% |

The welding process involves passing radio frequency (RF) waves through the banner and the tail portion. The radio frequency (RF) waves alter the molecular structure of the composition, which forms a weld between the two surfaces. In this process, the temperature is irrelevant. A flexible mounting member 72, 88, 89 is attached to each of the four sides of the banner 70.

The banner 70 substrate has the same radio frequency (RF) welding characteristics as the flexible mounting member 72, 88, 89. Typical composition of a banner is as follows:

| | |
|---|---|
| Support Fabric | PVC |
| Coating Weight per unit area | ca. 450/550 g/m$^2$ |
| Maximum tensile Load | ca. 250/230 daN/Scm |
| Tear Propagation Load | ca. 30/30 daN |
| Burning Behavior | <100 mm/min |
| Light fastness | 7-8 Years |
| Temperature Resistance | −30° C./+70° C. |

FIG. 9 shows examples of the upper frame portion 27, 30, 80 each having a head portion 82 comprising of a channel 83, said channel typically being similar in appearance to head portion 14 of retaining means 113. A tail portion 84 depends upwardly or downwardly there from. In use, a flexible mounting member 72 is slid into channel 83 so that the head 74 of the flexible mounting member 72 is retained therein.

In closing and locking the Vehicle Display System (FIG. 14), the flexible mounting member 72 and associated banner 70 are slid into channel 14 of the head portion 113 of the retaining means 112 which is engaged with the first locking member 24 via ball joint 115/118. The first locking member 124 is connected to the second locking member via joint 142/127. Once the banner 70 is positioned and the strut 148 depending from the second locking member is located in a suitable channel 163 of the frame 160, the first locking member 124 is moved towards the mushroom shaped protrusion 162 of the frame to produce tension in the banner 70. The force on head portion 113 from pulling on the flexible mounting member 72 and associated banner 70 is transferred to ball 115 and onto the surface of the deep recess 118 with which it engages. This transfers force on to the distal socket portion 127 and to the side of rod 142 and stem 143 against which it abuts. This force is then transferred to strut 148 positively locating it against the side of a channel 163 in the mounting means 160.

In this state, struts 134/135 which extend from the first locking member 124, act as a snap-lock, locates centrally over the mushroom shaped protrusions 162 of the mounting means 160 and when locked in this position, is unaffected by torsional stress in the Vehicle Display System. As a result of forces from head portion 113 being indirectly transferred to 148, struts 134/135 and channel 162 co-operate without influence from the banner 70 further assisted by rear 109 of head portion 113 and the distal end portion of the second locking member 151 locking together. The rear side 109 of the head portion 113 is configured to engage with an upright surface 151 proximate the distal end of the second locking member. Typically, the rear side 109 is received in a shallow depression in the distal end portion. Typically, the rear side 109 is received in a shallow depression in the distal end portion. When the retaining means is moved into the closed position, the head portion 113 snap-fits against 151 of the second locking member, transferring rotational torsional influences into a negative plane.

Once the banner 70 positioning and tensioning operation is complete, a finishing corner device 3 is secured in place (FIGS. 12 and 13). Corner finishing member 8 is located onto the corner retaining member 7 and secured by a screw 6 held in place by a captive thread 5. The corner device 3 has the same or similar grooves on the reverse side for adhesive as the frame portions 160, 27, 30, 80 and therefore the corner retaining member 7 or the corner finishing member 8 does not require invasive fixation to a vehicle.

Alternative retaining means 53, 54, 35 (as shown in FIGS. 6*a* to 6*c*) enter a negative plane when the struts 134, 135 and channel 162 co-operate, and in these embodiments head portion 113 is eliminated.

To unlock and open the vehicle display system, the corner finishing member 8 is removed and an opening tool 90 to apply lateral leverage to lip 38 of the first locking member 124. The tool 90 is typically made of aluminium and acts as a lever. The curve on the tool is ergonomical and is easier for an operator to hold. Lip 92 of 90 is used to lift the struts 134, 135 surrounding the mushroom shaped protrusions 162 from the channel 163 of the mounting means 160 (FIG. 14). Once the first locking member 124 is released and allowed to pivot on 142, the tension in the banner 70 is released and the strut 148 of the second locking member 140 can be removed from the channel 163.

The flexible mounting member 72 and associated banner 70 can then be slid out of channel 14 of the head portion 113 of the retaining means 112. The tensioning device 10 can be securely stored on the fixed mounting means 160 without a banner. Alternatively a replacement banner 70 can be displayed. FIG. 8 shows the vehicle display system in a stored and locked position. The method for locking and unlocking a stored vehicle display system is the same as if a banner were present.

Numerous modifications of the features are contemplated. For example, FIGS. 6*a* to 6*c* show variations 53, 54, 35 of the retaining means 112 and first locking member 124 in which the retaining means is an integral part of the first locking member 24. The same flexible mounting member 72 can be used in the channels of the head portions 51, 52 and 46 of the various retaining means.

In one modification, (FIG. 6*c*) there is an additional snap-lock 47 for improved fastening. The snap-lock is formed by a mushroom shaped protrusion extending from the second locking member 140 which is received in a corresponding channel in the first locking member 124. This feature could be incorporated in embodiments in which the retaining means is not integral with the first locking member.

The first locking member 124, when used with a frame 160 having ten mushroom shaped protrusions (FIG. 8*a*), is of sufficient size to allow a European legislative ECE104 compliant conspicuity marking to be displayed as an integral part of the member 124. The size of the members 124 and 140 may vary depending on the size of the banner 70 to be displayed, and the number of mushroom shaped protrusions 162. For example, if the banner size is up to 2 m×4 m (preferably 1.9 m×3.3 m), a mounting means 160 having about five mushroom shaped protrusions is sufficient. For banners that are typically 4 m×20 m (preferably 2.6 m×13.2 m) a mounting means 160 having about ten mushroom shaped protrusions is sufficient. For banners in excess of 4 m×20 m, mounting means having about fifteen mushroom shaped protrusions is preferred. Typically, all width variants of the mounting means are about 3.8 mm deep and may be glued, screwed or riveted to a vehicle, or attached thereto by other means.

The upper frame portion 27 illustrated in FIG. 9*a*, when combined with a mounting means 160, having ten mushroom shaped protrusions, gives consistent visual appearance on all four sides and allows legislative ECE104 tape to be applied. FIG. 9*b* shows an upper frame portion 80 is a variation of which is typically used in conjunction with the mounting means 160 having five mushroom shaped protrusions. The upper frame portion 30 in FIG. 9*a* provides a borderless top to the overall visual and is typically for use with the flexible mounting member 88, 89 on a roller shutter door.

Alternative embodiments, 88 and 89 of flexible members allow the vehicle display system to be mounted on a roller shutter door of a vehicle. A concertina portion 77 or a box portion 79 allows for approximately 5-25 mm of vertical expansion when the roller shutter door moves from a planar state into a stored state.

The flexible mounting member 72 may have an elastic portion 75 for accommodating expansion and contraction between the head 74 and beading 78. This ensures the flexible mounting means 72 expands and contracts to accommodate the varying characteristics of the banner 70 in different temperature and tensioning conditions. For example, relaxation as a result of increased heat and shrinkage as a result of decreased heat of the banner 70 after it has been fixed and tensioned in the retaining means channel 14 of the head portion 113 and 27, 80, 30.

The head portion of the flexible mounting member 74 may be alternatively shaped such as round, elliptical or semi elliptical, with a corresponding change to the retaining means channels 14, 51, 52, 46. However, it is preferable that the base of the channel is substantially planar to avoid the Keder collapsing if an impact causes pressure thereon. Rounded/curved channels have less structural integrity and are not preferable therefore.

Banners are typically made of PVC compound with print directly thereon. However, banners may have printed self-adhesive vinyl applied to them. Directly printed PVC banners are re-usable in the vehicle display system, but the message directly printed on the PVC banner can not be changed. However, Banners that have printed self-adhesive vinyl applied to them are re-usable in the Vehicle Display System and can have the message changed, resulting in a more labour intensive, but an environmentally friendly alternative.

The tensioning device may be additionally attached to a vehicle via screws or other mechanical fixings. However, this is optional as the adhesive is sufficient to securely fasten the system to the vehicle. Furthermore, it is only desirable for non-refrigerated vehicles since the screws will pierce the vehicle body.

For attachment to a static object or structure, the system as actually shown in FIGS. 2 and 3 may be used, viz without the third strut 135. Where such a system is not subjected to vibration, the additional security provided by strut 135 is not essential.

The invention claimed is:

1. A securing system for use in a system for displaying a banner on a vehicle, the securing system comprising:

elongate mounting means for attaching to the vehicle, said mounting means in a form of an elongate strip having at least two longitudinal substantially parallel spaced apart channels therein;

locking means; and retaining means for retaining a banner, said retaining means being associated with said locking means, said locking means providing for engagement with said at least two spaced apart channels, said locking means comprising first and second locking members, said first locking member of said locking means having a first protruding strut locatable in a first channel of said at least two spaced apart channels, said first locking member of said locking means having a further protruding strut spaced apart from said first protruding strut and locatable within a second channel of said at least two spaced apart channels, said second locking member of said locking means having a second protruding strut locatable in said first channel of said at least two spaced apart channels, wherein said first locking member of said locking means is movable relative to said second locking member of said locking means such that, when said first and second locking members are aligned, said first protruding strut of said first locking member and said second protruding strut of said second locking member are adjacent each other, adjacent sides of said first and second protruding struts being parallel, whereby, when said first protruding strut of said first locking member, said further protruding strut of said first locking member, and said second protruding strut of said second locking member are located in said first and second of said at least two spaced apart channels, said locking means is securely fastened to said elongate mounting means.

2. A system according to claim 1, wherein each strut extends substantially perpendicular to its respective member.

3. A system according to claim 1 wherein the retaining means is connectable to the locking means.

4. A system according to claim 3 wherein the retaining means is connectable to the locking means by a pivot.

5. A system according to claim 1, wherein the retaining means is integral with the first locking member.

6. A system according to claim 1, wherein when the first and second locking members are aligned, the distal ends of at least two of the struts are aligned.

7. A system according to claim 1 wherein, for at least one of the struts, the side of the strut facing the respective channel in use is flared.

8. A system according to claim 1 wherein, the first locking member is pivotable with respect to the second locking member.

9. A system according to claim 1, wherein the retaining means is pivotable with respect to the locking means.

10. A system according to claim 1, wherein the retaining means has a head portion incorporating a channel.

11. A system according to claim 1 further comprising a flexible mounting member for mounting a banner.

12. A system according to claim 1, wherein the mounting means has more than two channels.

13. A system according to claim 12, wherein the retaining means is connectable to the locking means by a pivot and has a head portion incorporating a channel for mounting a flexible mounting member, and when the first and second locking members are aligned in the closed position of the locking members, the distal ends of at least two of the struts are aligned.

14. A system according to claim 12, wherein the retaining means is integral with the first locking member incorporating a channel for mounting a flexible mounting member, and when the first and second locking members are aligned in the closed position of the locking members, the distal ends of at least two of the struts are aligned.

15. A method for displaying a banner on a vehicle comprising the steps of:

attaching the banner to a flexible mounting member;

attaching elongate mounting means to the vehicle, said mounting means in a form of an elongate strip having at least two longitudinal substantially parallel spaced apart channels therein;

securing said flexible mounting member to retaining means for retaining said banner, said retaining means being provided with locking means for engagement with the said at least two spaced apart channels, said locking means comprising first and second locking members, said first locking member having a first protruding strut locatable in a first channel of said at least two spaced apart channels, said second locking member having a second protruding strut locatable in said first channel of said at least two spaced apart channels, said first locking member further having a further protruding strut spaced apart from said first protruding strut and locatable in a second channel of said at least two spaced apart channels;

locating said second protruding strut in said first channel;

moving said first locking member relative to said second locking member such that said first and second locking members are aligned and said first protruding strut and said second protruding strut are located in said first channel and are adjacent each other, adjacent sides of said first and second protruding struts being parallel; and locating a said further protruding strut of said first locking member in said second channel such that when said first protruding strut of said first locking member, said further protruding strut of said first locking member, and said second protruding strut of said second locking member are located in said first and second of said at least two spaced apart channels, said locking means is securely fastened to said elongate mounting means.

16. A method according to claim 15, wherein the step of attaching the banner to the flexible mounting member comprises welding using radio frequency waves.

17. A method according to claim 16, wherein the mounting means is attached to the vehicle by adhesive means.

* * * * *